United States Patent [19]

Sepso et al.

[11] Patent Number: 4,819,442

[45] Date of Patent: Apr. 11, 1989

[54] REFRIGERATOR SYSTEM, CONTROL DEVICE THEREFOR AND METHODS OF MAKING AND OPERATING THE SAME

[75] Inventors: Roger P. Sepso, Stratford; Charles J. Everett, Killingworth, both of Conn.

[73] Assignee: Robertshaw Controls Company, Richmond, Va.

[21] Appl. No.: 159,883

[22] Filed: Feb. 24, 1988

[51] Int. Cl.[4] ..... F25D 17/08

[52] U.S. Cl. ..... 62/187; 236/49.3

[58] Field of Search ..... 62/187, 179; 98/116; 60/434; 236/49 B, 49 D

[56] References Cited

U.S. PATENT DOCUMENTS

| | | | |
|---|---|---|---|
| 1,828,016 | 10/1931 | Andres | 98/116 |
| 3,004,484 | 10/1961 | Lorenz | 98/116 |
| 3,288,370 | 11/1966 | Mingrove et al. | 236/49 |
| 3,917,433 | 11/1975 | Tomitaka | 98/116 X |
| 4,276,754 | 7/1981 | Ty | 62/187 |

*Primary Examiner*—William E. Tapolcai

*Attorney, Agent, or Firm*—Candor, Candor & Tassone

[57] ABSTRACT

A refrigerator system, a control device therefor and methods of making and operating the same are provided, the system having a frozen food compartment and a non-frozen food compartment interconnected together by an air circulating unit that has a control valve unit therein for controlling the amount of opening of the air circulating unit between the compartments, the control valve unit comprising a housing having a movable valve member and a temperature sensing unit operatively interconnected to the valve member to control the position of the valve member in relation to the temperature sensed by the temperature sensing unit, the system having a fan for forcing an air flow through the air circulating unit from the frozen food compartment to the non-frozen food compartment when the fan is operating and the valve member is in an open condition thereof, the system having structure for causing the fan to be operating only when the valve member is in a certain open condition thereof.

24 Claims, 3 Drawing Sheets

REFRIGERATOR SYSTEM, CONTROL DEVICE THEREFOR AND METHODS OF MAKING AND OPERATING THE SAME

BACKGROUND OF THE INVENTION

1. Field of the Invention

This invention relates to a new refrigeration system and to a new control device for a refrigeration system as well as to new methods of making and operating the same.

2. Prior Art Statement

It is known to provide a refrigerator system having a frozen food compartment and a non-frozen food compartment interconnected together by an air circulating means that has a control valve means therein for controlling the amount of opening of the air circulating means between the compartments, the control valve means comprising a housing means having a movable valve member and a temperature sensing means operatively interconnected to the valve member to control the position of the valve member in relation to the temperature sensed by the temperature sensing means, the system having a fan means for forcing an air flow through the air circulating means from the frozen food compartment to the non-frozen food compartment when the fan means is operating and the valve member is in an open condition thereof. For example, see the U.S. Pat. to Mingrone et al, No. 3,288,370, and FIGS. 1 and 2 of this application.

SUMMARY OF THE INVENTION

One feature of this invention is to provide a new refrigerator system wherein the fan means for the air circulating means thereof is operated in a unique manner.

In particular, it is well known that in prior known refrigerator systems wherein each has a frozen food compartment and a non-frozen food compartment interconnected together by an air circulating means that has a control valve means therein for controlling the amount of opening of the air circulating means between the compartments in relation to the temperature sensed by the temperature sensing means of the control valve means, the valve member of the air circulating means will be opened proportionately allowing air to be circulated from the frozen food compartment to the non-frozen food compartment. If this air circulation is due only to gravity, the transfer is slow and, therefore, inefficient and costly. Attempts to speed up this circulation with a fan means have been mostly unsuccessful as a fan means placed in the system has had to run continuously so as to force flow through the open periods between compartments.

However, it was found according to the teachings of this invention, that means could be provided to cause the fan means to only operate when the variable opening provided in the air circulating means is of at least the proper magnitude whereby it is believed that such an arrangement will economically provide the required volume of cold air to one or more compartments of a multi-compartmented refrigerator unit or the like.

For example, one embodiment of this invention provides a refrigerator system having a frozen food compartment and a non-frozen food compartment interconnected together by an air circulating means that has a control valve means therein for controlling the amount of opening of the air circulating means between the compartments, the control valve means comprising a housing means having a movable valve member and a temperature sensing means operatively interconnected to the valve member to control the position of the valve member in relation to the temperature sensed by the temperature sensing means, the system having a fan means for forcing an air flow through the air circulating means from the frozen food compartment to the non-frozen food compartment when the fan means is operating and the valve member is in an open condition thereof, the system having means for causing the fan means to be operating only when the valve member is in a certain open condition thereof.

Accordingly, it is an object of this invention to provide a new refrigerator system having one or more of the novel features of this invention as set forth above or hereinafter shown or described.

Another object of this invention is to provide a new method of making such a refrigerator system, the method of this invention having one or more of the novel features of this invention as set forth above or hereinafter shown or described.

Another object of this invention is to provide a new method of operating a refrigerator system, the method of this invention having one or more of the novel features of this invention as set forth above or hereinafter shown or described.

Another object of this invention is to provide a new control device for a refrigerator system, the control device of this invention having one or more of the novel features of this invention as set forth above or hereinafter shown or described.

Another object of this invention is to provide a new method of making a control device for a refrigerator system, the method of this invention having one or more of the novel features of this invention as set forth above or hereinafter shown or described.

Other objects, uses and advantages of this invention are apparent from a reading of this description which proceeds with references to the accompanying drawings forming a part thereof and wherein:

DESCRIPTION OF THE PREFERRED EMBODIMENT

Figure 1:
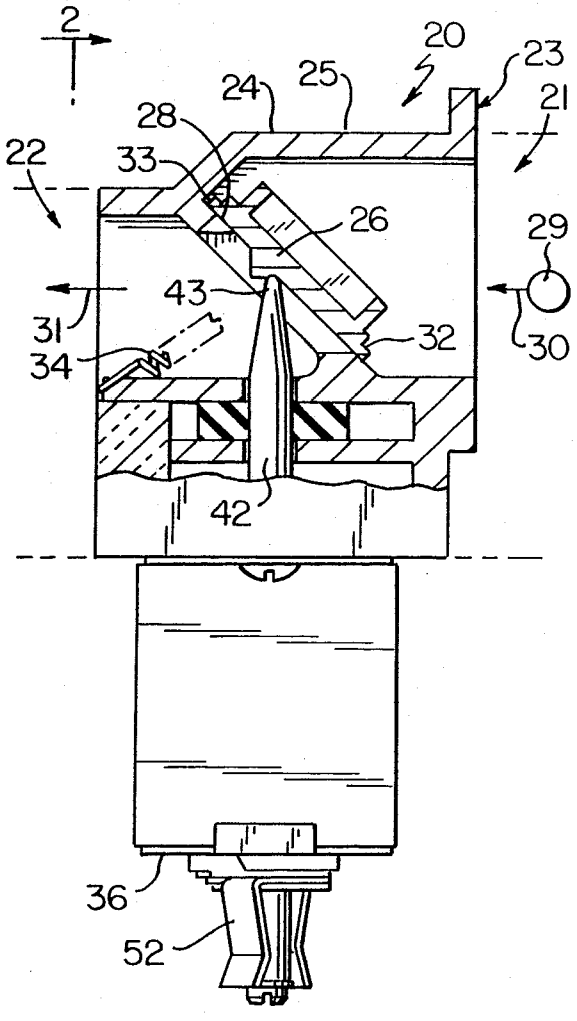
FIG. 1 PRIOR ART
FIG. 1 is a fragmentary side view, partially in cross section, illustrating a prior known refrigerator system.

While the various features of this invention are hereinafter described and illustrated as being particularly adapted to provide a refrigerator system for a refrigerator that has a frozen food compartment and a non-frozen food compartment, it is to be understood that the various features of this invention can be utilized singly or in various combinations thereof to provide a refrigerator system for other types of refrigerators or the like, such as where one compartment merely has colder air provided therein than another compartment thereof and/or more than two compartments are being provided therein as desired.

Therefore, this invention is not to be limited to only the embodiment illustrated in the drawings, because the drawings are merely utilized to illustrate one of the wide variety of uses of this invention.

Figure 2:
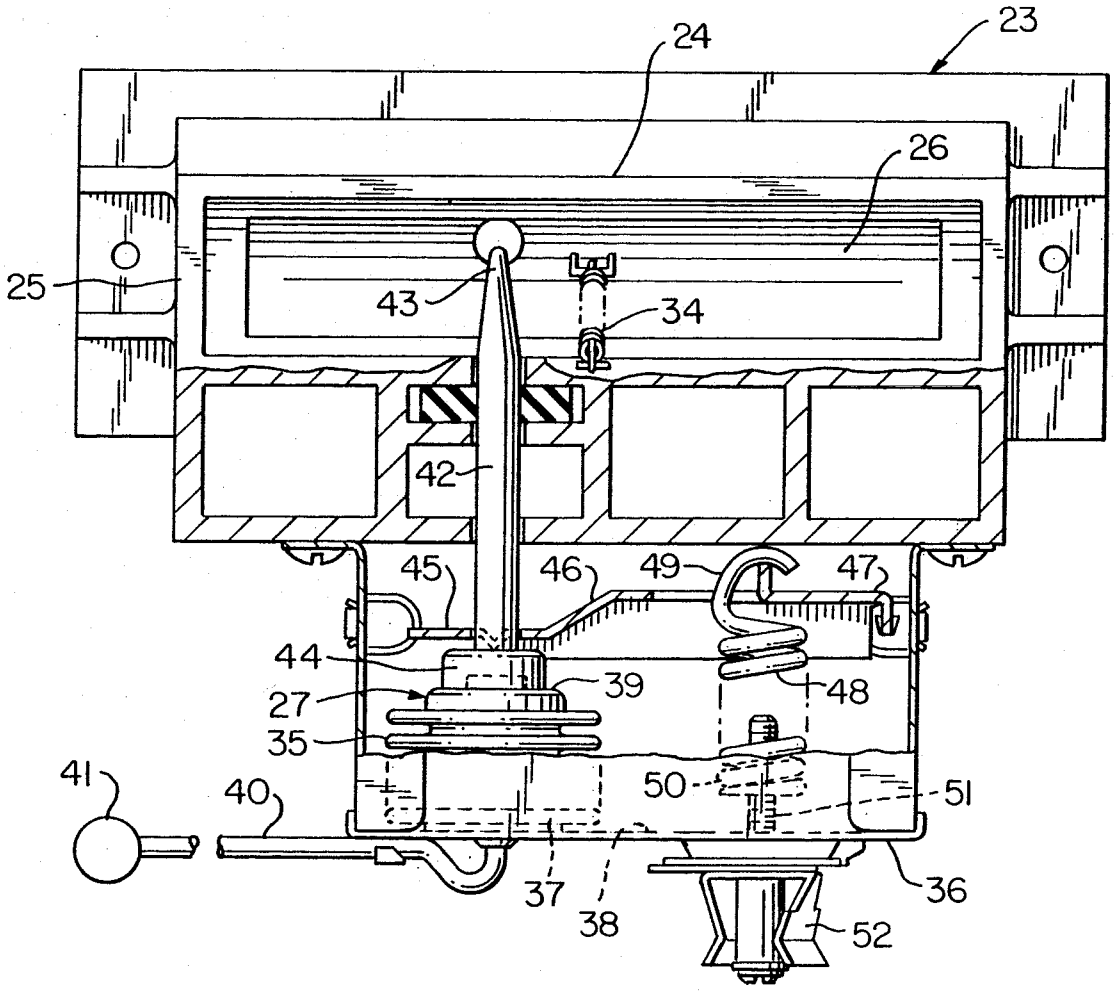
FIG. 2 PRIOR ART
FIG. 2 is a front view of the control device of the prior known refrigerator system of FIG. 1 and is taken in the direction of the arrows 2—2 of FIG. 1, FIG. 2 being partially in cross section.

Referring now to FIGS. 1 and 2, a prior known refrigerator system is generally indicated by the reference numeral 20 and comprises a frozen food compartment 21 and a non-frozen food compartment 22 interconnected together by an air circulating means 23 that has a control valve means 24 therein for controlling the amount of opening of the air circulating means between the compartments 21 and 22 thereof. The control valve means 24 comprises a housing means 25 having a movable valve member 26 and a temperature sensing means 27 operatively interconnected to the valve member 26 to control the position of the valve member 26 relative to a valve seat 28 of the housing means 25 in relation to the temperature sensed by the temperature sensing means 27 in a manner hereinafter set forth. The system 20 also has an electrically operated fan means 29 for forcing an air flow through the air circulating means 23 from the frozen food compartment 21 to the non-frozen food compartment 22, as represented by the arrows 30 and 31, when the fan means 29 is operating and the valve member 26 is in an open condition thereof.

The valve member 26 is pivotally mounted to the housing means 25 at the lower end 32 thereof so that the upper end 33 thereof is adapted to pivot toward and away from the valve seat 28, the valve member 26 having a tension spring 34 interconnected thereto and tending to pivot the valve member 26 in a closing direction thereof.

The temperature sensing means 27 for operating the valve member 26 comprises a bellows construction 35 disposed within a frame structure 36 that comprises part of the housing means 25, the bellows construction 35 having one end 37 secured against an inside surface 38 of the frame structure 36 and the other end 39 being free to move relative thereto. The interior of the bellows construction 35 is interconnected by a capillary tube 40 to a temperature sensing bulb 41 whereby the temperature sensing fluid disposed within the bellows construction 35, capillary tube 40 and bulb 41 will cause the movable end or wall 39 to move upwardly in FIG. 2 as the temperature of the air or fluid adjacent the bulb 41 increases and will cause the movable wall 39 to move downwardly in FIG. 2 as the temperature of the air or fluid adjacent the bulb 41 decreases all in a manner well known in the art.

An axially movable plunger 42 is carried by the housing means 25 and has one end 43 operatively interconnected to the valve member 26 and the other end 44 thereof held against the movable wall 39 of the bellows construction 35 by an end 45 of a lever 46 that has its other end 47 pivotally mounted to the frame means 36 and being urged to pivot in a counterclockwise direction in FIG. 2 by an adjustable range spring 48 having one end 49 bearing against the lever 45 and the other end 50 thereof being threadedly interconnected to an adjusting screw 51 that is adapted to set the force of the range spring 48 acting on the lever 46 by rotation of a control knob 52 in a manner well known in the art.

In particular, the details of the structure and operation of the prior known control device 24 are fully set forth in the aforementioned patent in Mingrone et al, No. 3,288,370, whereby this patent is being incorporated into this disclosure by this reference thereto.

Thus, it can be seen that the prior known refrigerator system 20 is so constructed and arranged that the same is adapted to have the temperature sensing bulb 41 of the temperature sensing means 27 sense the temperature in the non-frozen food compartment 22 so that when the same rises above a certain temperature that has been selected by the control knob 52, the bellows construction 35 has expanded in such a manner that the movable wall 39 has moved upwardly in opposition to the force of the range spring 48 and thereby has axially moved the plunger 42 in such a manner that the same opens the valve member 26 relative to the valve seat 28 in opposition to the force of the tension spring 34 to permit the colder air in the frozen food compartment 21 to now pass through the circulating means 23 to the non-frozen food compartment 22 to reduce the temperature thereof. As previously stated, in order to increase the amount of the air flowing through the air circulating means 23 when the valve member 26 is in an open condition thereof, the fan means 29 is provided and is continuously operated during the use of the refrigerator system 20 so that when the valve member 26 is in an open condition, the fan means 29 assists in forcing the flow of colder air from the compartment 21 through the air circulating means 23 to the non-frozen food compartment 22.

When the temperature of the air in the non-frozen food compartment 22 now falls below the selected temperature, the bellows construction 35 has collapsed sufficiently so that the force of the range spring 48 has pulled downwardly on the lever 46 and, thus, allows the plunger 42 to permit the valve member 26 to close against the valve seat 28 by the force of the tension spring 34 and thereby terminates the flow of colder air through the air circulating means 23 to the non-frozen food compartment 22.

Therefore, it can be seen that the temperature sensing means 27 positions the valve member 26 relative to the valve seat 28 in various operating positions thereof depending upon the temperature being sensed by the temperature sensing bulb 41.

However, as previously stated, it was found according to the teachings of this invention that it is uneconomical to have the fan means 29 continuously operating, and, in fact, it is believed the use of such fan means 29 is only effective when the valve member 26 is open relative to the valve seat 28 a certain magnitude or greater.

Therefore, it was found according to the teachings of this invention that the fan means 29 can be turned on only when the valve member 26 is in at least a certain open condition thereof.

In particular, such unique feature of this invention is provided in the new refrigerator system and new control device of this invention that are respectfully indicated by the reference numeral 20A and 24A in FIGS. 3–9 whereby parts thereof that are similar to the prior known refrigerator system 20 and control device 24 are indicated by like reference numerals followed by the reference letter "A".

As illustrated in FIGS. 3–10, the system 20A and control device 24A of this invention are substantially identical to the system 20 and control device 24 previously described except that an electrical switch assembly that is generally indicated by the reference numeral 60 is carried by the frame means 36A of the housing means 25A of the control device 24A in a manner hereinafter set forth and is electrically interconnected to the fan means 29A by lead means 61 so as to turn on the fan means 29A only when the valve member 26A of the control device 24A is at a certain open condition thereof as will be apparent hereinafter.

Figure 9:
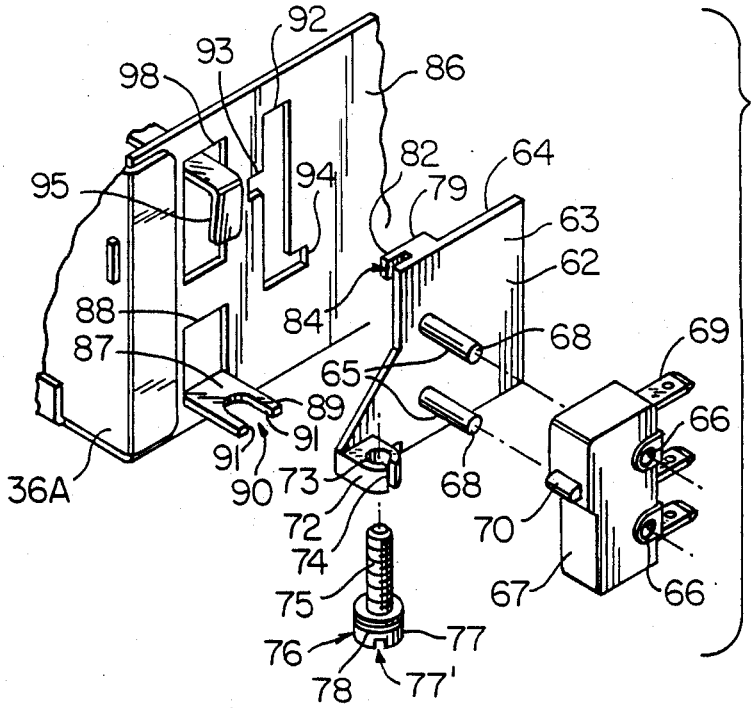
FIG. 9 is an exploded perspective view of the various parts of the electrical switch assembly of FIG. 7 in combination with a fragmentary portion of the housing means of the control device that receives such electrical switch assembly.
Figure 7:
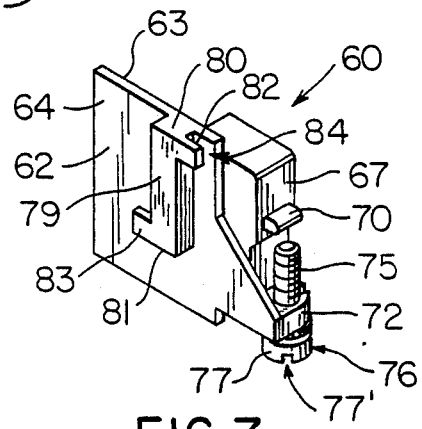
FIG. 7 is a rear perspective view of the electrical switch assembly for the control device of FIG. 4.
Figure 8:
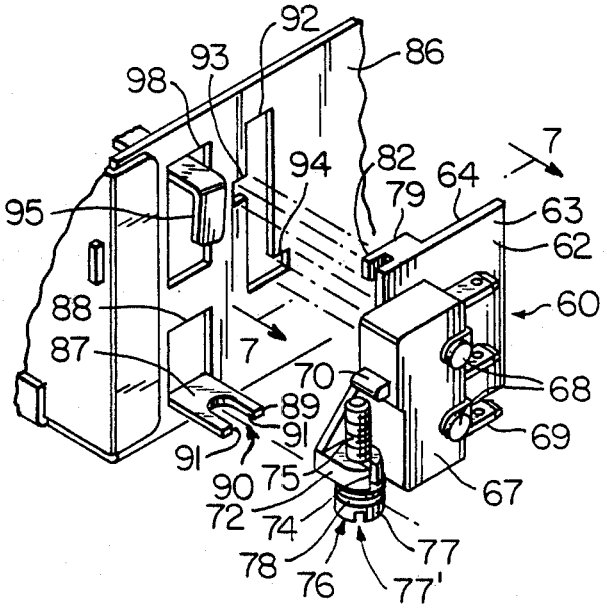
FIG. 8 is a fragmentary exploded perspective view illustrating how the electrical switch assembly of FIG. 7 is to be assembled to the housing means of the control device of FIG. 4.
Figure 5:
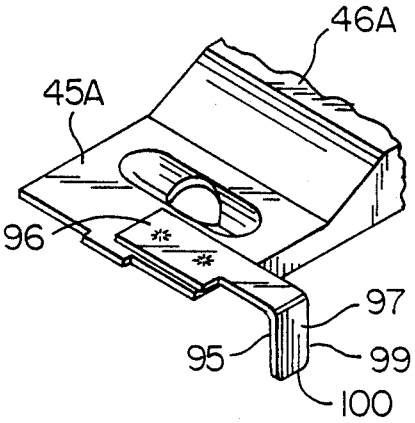
FIG. 5 is a fragmentary perspective view illustrating the bellows lever of the control device of FIG. 4 and the electrical switch actuator of this invention that is secured thereto.

The electrical switch assembly 60 as best illustrated in FIGS. 7, 8 and 9 comprises a substantially flat plate-like member 62 having opposed flat parallel sides 63 and 64, the side 63 having a pair of cyclindrical posts 65 secured thereto and extending outwardly therefrom in spaced parallel relation to be respectively received through suitable mounting openings 66 passing through an electrical switch 67 so as to mount the electrical switch 67 to the side 63 of the plate 62 and fasten the same thereto by having the outer free ends 68 thereof turned over or upset in the manner illustrated in FIG. 8, such as by ultrasonic rivet forming means or the like.

The electrical switch 67 has a plurality of terminals 69 extending outwardly therefrom and an axially movable plunger means 70 which when permitted to move axially outwardly by internal spring means (not shown) will cause the electrical switch 67 to turn on the fan means 29A. Conversely, when the plunger means 70 of the switch 67 is urged inwardly to a certain position thereof, the switch 67 terminates the operation of the fan means 29A, this operation of the switch means 67 being well known in the art of electrical switch means.

The mounting plate 62 for the electrical switch 67 has a flange-like portion 72 also extending outwardly from the flat side 63 thereof and having an opening 73 passing transversely therethrough, the flange 72 being split at 74 so as to permit the opening 73 to threadedly receive a threaded shaft 75 of an adjusting member 76 that has an enlarged head 77 provided with an annular groove 78 therein for a purpose hereinafter set forth. The enlarged head 77 of the adjusting screw 76 has a slot 77' therein for receiving the end of a screwdriver or the like for turning the adjusting screw 76 so that the threaded relationship of the shaft 75 thereof with the opening 73 of the mounting plate 62 can be adjusted as will be apparent hereinafter.

The mounting plate 62 has a substantially rectangular projection 79 disposed on the rear side 64 thereof, the projection 79 having opposed upper and lower ends 80 and 81 respectively provided with oppositely directed tabs 82 and 83 which are respectively spaced from the flat side 64 of the plate 62 and are disposed substantially parallel thereto so as to define slot means 84 and 85 therewith.

While the mounting plate 62 can be formed of any suitable material and in any suitable manner, the same can comprise plastic material that has been molded into a one-piece arrangement as illustrated.

The frame means 36A of the housing means 25A of the control device 24A has an upstanding sidewall 86 that is formed of metallic material. The sidewall 86 has a tang 87 carved therefrom to define a slot means 88 therethrough while the tang means 87 remains integral and one-piece with the wall 86 and projects outwardly therefrom substantially at a right angle relative thereto. The free end 89 of the tang 87 is interrupted by a substantially U-shaped slot 90 that defines opposed edge means 91 that are adapted to be respectively received in the annular groove 78 of the enlarged head 77 of the adjusting screw 76 when the same is assembled to the sidewall means 86 in a manner hereinafter set forth whereby the tang 87 will support the weight of the electrical switch assembly 60 and prevent the adjusting screw 76 from moving axially relative to the housing means 25A but permitting the adjusting screw 76 to be rotated therein and cause the plate 62 to be axially moved upwardly and downwardly relative to the sidewall 86 as the adjusting screw 76 is rotated in the slot 90.

Figure 4:
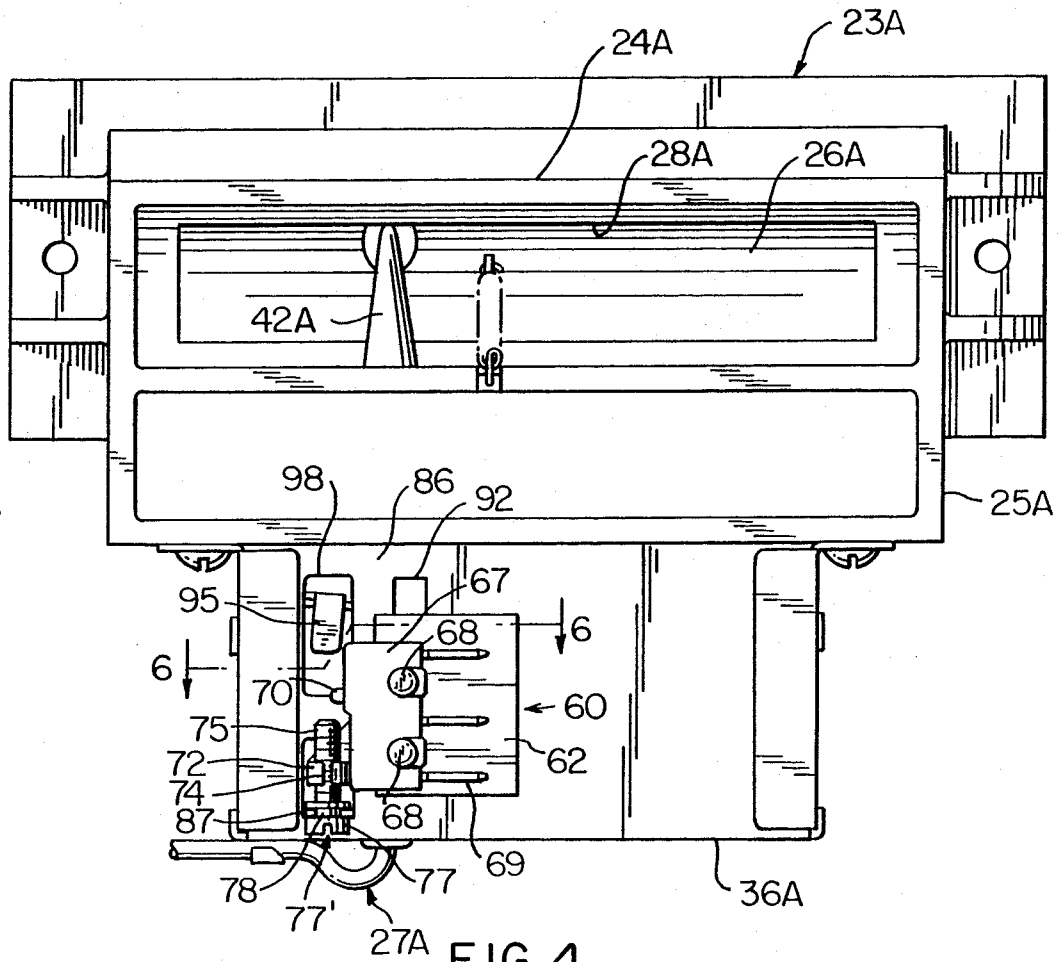
FIG. 4 is a front view of the new control device of the refrigerator system of this invention and is taken in the direction of the arrows 4—4 of FIG. 3.
Figure 3:
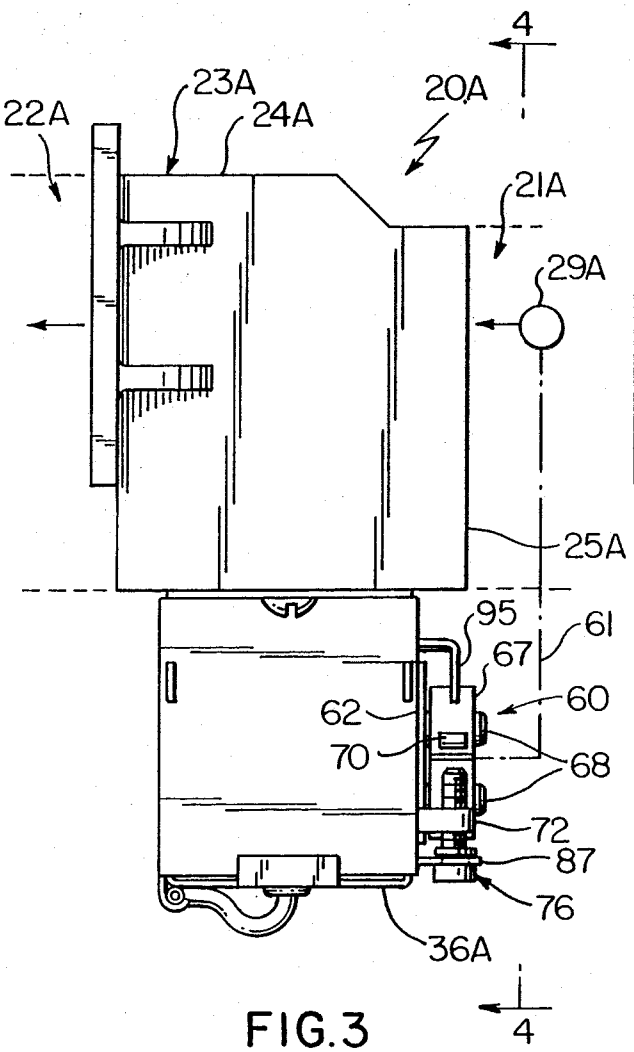
FIG. 3 is a view similar to FIG. 1 and illustrates the new refrigerator system of this invention.
Figure 6:
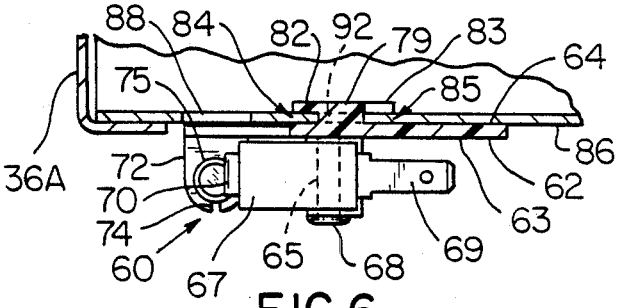
FIG. 6 is a fragmentary cross-sectional view taken on line 6—6 of FIG. 4.

The sidewall 86 of the housing means 25A of the control device 24A has a substantially rectangular vertical slot 92 formed therethrough and interconnecting with two laterally extending portions 93 and 94 which respectively are spaced apart a distance similar to the tabs 82 and 83 of the projection 79 of the plate 62 and extend in opposite directions so that the tabs 82 and 83 can be aligned with the portions 93 and 94 and pass therethrough when the plate 62 is moved against the wall 86 whereby the slots 84 and 85 created by the tabs 82 and 83 with the side 64 of the plate 62 are adapted to receive the sidewall 86 therein in the manner illustrated in FIG. 6 when the plate 62 is moved upwardly in the slot 92 after the projection 79 and tabs 82 and 83 have been fully received through the slot 92 as illustrated in FIG. 8. At the same time that the projection 79 is being received through the slot 92 in the sidewall 86, the enlarged head 77 of the adjusting screw 76 is being received in the slot 90 of the tab 87 as illustrated in FIGS. 3 and 4.

Figure 10:
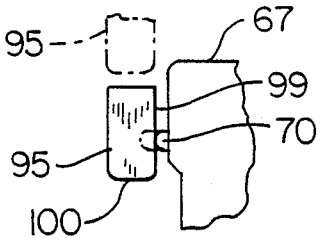
FIG. 10 is a fragmentary side view of the electrical switch means and the actuator means therefor.

A switch actuator 95 is formed from a flat metal part that is bent into an L shape to define two flat legs 96 and 97 disposed at right angles relative thereto, the leg 96 being welded or otherwise fixed to the end 45A of the pivotally mounted bellows lever 46A in the manner illustrated so that the leg 95 will project out through another rectangular opening 98 formed through the sidewall 86 of the housing 25A so that the edge 99 of the leg 97 will be adapted to engage against the plunger 70 of the electrical switch 67 in the manner illustrated in full lines in FIG. 10 when the temperature sensing means 27A of the control device 24A is sensing a temperature that is requiring the switch means 67 to prevent the operation of the fan means 29A. However, as the temperature sensed by the temperature sensing means 27A rises above the temperature where the lever 46A causes the plunger 42A to position the valve member 26A to provide an opening of a size where it is desired to have the fan means 29A operating, the edge 99 of the leg 97 of the actuator 95 is now out of engagement with the switch plunger 70 in the manner illustrated by dotted lines in FIG. 10 so as to cause the switch means 67 to operate the fan means 29A to increase the air flow through the air circulation means 23A.

The leg 97 of the actuator 95 has the free end 100 thereof adapted to cam against the switch plunger 70 and cause the same to move axially inwardly as the end 100 moves downwardly past the same in the manner illustrated in FIG. 10 as the temperature sensed by the temperature sensing means 27A begins to fall to the selected temperature so as to cause the switch means 67 to terminate the operation of the fan means 29A.

Therefore, it can be seen that the switch assembly 60 of this invention can be formed in a relatively simple manner by the method of this invention and be assembled to the housing means 25A of the control device 24A in a simple manner by the method of this invention so that by merely turning the adjusting screw 76, the switch assembly 60 will slide to a desired position on the sidewall 86 of the housing 25A because rotation of the adjusting screw 76 causes the threaded relation between the threaded shank 75 of the adjusting screw 76 and the opening 73 of the flange 72 to cause the plate 62 to move upwardly or downwardly on the rotating adjusting screw 76 depending upon the rotational direction thereof. In this manner, the adjusted position of the switch plunger 70 relative to the bellows lever 46A will determine the particular temperature which will cause the switch means 67 to operate the fan means 29A or to terminate the operation of the fan means 29A which will be at a certain magnitude of opening of the valve member 26A for the reasons previously set forth.

Therefore, it can be seen that the control device 24A and the system 20A of this invention can be formed in a relatively simple manner by the method of this invention to operate in a manner now to be described.

Once the control device 24A of this invention has been disposed in the system 20A and the adjusting screw 76 has been rotated in a manner to position the plunger 70 of the switch 67 to the desired position so that at a desired temperature sensed by the bulb 41, the switch means 67 will cause the fan means 29A to operate, the fan means 29A will not be operating as long as the temperature sensed by the bulb 41 is below that set temperature.

However, that selected set temperature is a temperature such that the temperature being sensed by the temperature sensing bulb 41 is causing the valve member 26A to be in at least a certain partially open condition and it is only when the temperature sensed by the bulb 41 rises to the set temperature, and thereby causes the bellows lever 46A to pivot upwardly in FIG. 2 and cause the valve member 26A to open to that certain partially open position thereof will the end 100 of the actuator 95 move out of alignment with the plunger 70 of the electrical switch 67 so that the electrical switch 67 will now cause the fan means 29A to operate and assist in forcing the colder air from the compartment 21A through the air circulation means 23A to the compartment 22A.

However, as the temperature in the compartment 22A now falls below the set temperature of the adjusting screw 76, the valve member 26A has closed to a position where the end 100 of the actuator 95 now engages against the plunger 70 and has moved the same axially inwardly by the edge means 99 thereof so that the switch means 67 now turns off the fan means 29A even though the valve member 26A is still in an open position thereof.

Thus, it can be seen that the valve member 26A will be opened and closed against the valve seat 28A at a temperature that is below the temperature that causes the switch means 67 to operate the fan means 29A and such differential between such two temperatures can be readily adjusted by the adjusting member 76 by sliding the switch assembly 60 relative to the housing 25A for the reasons previously set forth.

In this manner, the switch means 67 can be adjusted to begin to operate the fan means 29A anywhere between just an initial cracking open of the valve member 26A from the valve seat 28A to where the valve member 26A is in a fully open position, if desired. However, as previously set forth, it is believed that for optimum use of the fan means 29A, the fan means 29A should begin to operate only after the valve member 26A has been moved to a partially open position thereof to effectively permit the increased amount of air flow provided by the fan means 29A to flow through the control device 24A.

Therefore, it can be seen that this invention not only provides a new refrigerator system and control device therefor, but also this invention provides new methods of making and operating such a system and such a device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim according to this invention in the portion of each claim that is disposed after the terms "the improvement" whereby it is believed that each claim sets forth a novel, useful and unobvious invention within the purview of the Patent Statute.

What is claimed is:

1. In a refrigerator system having a frozen food compartment and a non-frozen food compartment interconnected together by an air circulating means that has a control valve means therein for controlling the amount of opening of said air circulating means between said compartments, said control valve means comprising a housing means having a movable valve member and a temperature sensing means having movable means operatively interconnected to said valve member to control the position of said valve member in relation to the temperature sensed by said temperature sensing means, said system having a fan means for forcing an air flow through said air circulating means from said frozen food compartment to said non-frozen food compartment when said fan means is operating and said valve member is in an open condition thereof, the improvement wherein said movable means of said temperature sensing means is operatively internconnected to said fan means for causing said fan means to be operating only when said valve member is in a certain open condition thereof.

2. In a refrigerator system having a frozen food compartment and a non-frozen food compartment interconnected together by an air circulating means that has a control valve means therein for controlling the amount of opening of said air circulating means between said compartments, said control valve means comprising a housing means having a movable valve member and a temperature sensing means operatively interconnected to said valve member to control the position of said valve member in relation to the temperature sensed by said temperature sensing means, said system having a fan means for forcing an air flow through said air circulating means from said frozen food compartment to said non-frozen food compartment when said fan means is operating and said valve member is in an open condition thereof, the improvement wherein said system has means for causing said fan means to be operating only when said valve member is in a certain open condition thereof, said means of said system for causing said fan means to be operating only when said valve member is in a certain open condition thereof comprising an electrical switch means carried by said housing means, said switch means causing said fan means to be operating only when said switch means is actuated to a certain condition thereof, said temperature sensing means having means operatively interconnected with said switch means to actuate said switch means to said certain condition thereof only when said temperature sensing means is causing said valve member to be in said certain open condition thereof.

3. A system as set forth in claim 2 wherein said means of said temperature sensing means that is operatively interconnected to said switch means comprises a lever that is pivotally mounted to said housing means.

4. A system as set forth in claim 3 wherein said switch means has an axially movable plunger means which when moved a certain amount actuate said switch means, said lever having an abutment means that is adapted to be in engagement with said plunger means whereby said plunger means is adapted to move in unison with said lever.

5. A system as set forth in claim 4 wherein said switch means is adjustably mounted to said housing means.

6. A system as set forth in claim 5 wherein said housing means has an exterior surface means, said switch means being slideably mounted on said exterior surface means of said housing means.

7. In a control device for a refrigerator system having a frozen food compartment and a non-frozen food compartment interconnected together by an air circulating means that has a fan means therein for forcing an air flow through said air circulating means from said frozen food compartment to said non-frozen food compartment when said fan means is operating and a valve member of the control device is in an open condition thereof, said control device comprising a housing means having a movable valve member for controlling the amount of opening of said air circulating means between said compartments and a temperature sensing means having movable means operatively interconnected to said valve member to control the position of said valve member in relation to the temperature sensed by said temperature sensing means, the improvement wherein said movable means of said temperature sensing means is adapted to be operatively interconnected to said fan means for causing said fan means to be operating only when said valve member is in a certain open condition thereof.

8. In a control device for a refrigerator system having a frozen food compartment and a non-frozen food compartment interconnected together by an air circulating means that has a fan means therein for forcing an air flow through said air circulating means from said frozen food compartment to said non-frozen food compartment when said fan means is operating and a valve member of the control device is in an open condition thereof, said control device comprising a housing means having a movable valve member for controlling the amount of opening of said air circulating means between said compartments and a temperature sensing means operatively interconnected to said valve member to control the position of said valve member in relation to the temperature sensed by said temperature sensing means, the improvement wherein said control device has means for causing said fan means to be operating only when said valve member is in a certain open condition thereof, said means of said control device for causing said fan means to be operating only when said valve member is in a certain open condition thereof comprising an electrical switch means carried by said housing means, said switch means being adapted to cause said fan means to be operating only when said switch means is actuated to a certain condition thereof, said temperature sensing means having means operatively interconnected with said switch means to actuate said switch means to said certain condition thereof only when said temperature sensing means is causing said valve member to be in said certain open condition thereof.

9. A control device as set forth in claim 8 wherein said means of said temperature sensing means that is operatively interconnected to said switch means comprises a lever that is pivotally mounted to said housing means.

10. A control device as set forth in claim 9 wherein said switch means has an axially movable plunger means which when moved a certain amount actuates said switch means, said enggement with said plunger means whereby said plunger means lever having an abutment means that is adapted to be in is adapted to move in unison with said lever.

11. A control device as set forth in claim 10 wherein said switch means is adjustably mounted to said housing means.

12. A control device as set forth in claim 11 wherein said housing means has an exterior surface means, said switch means being slideably mounted on said exterior surface means of said housing means.

13. In a method of making a control device for a refrigerator system having a frozen food compartment and a non-frozen food compartment interconnected together by an air circulating means that has a fan means therein for forcing an air flow through said air circulating means from said frozen food compartment to said non-frozen food compartment when said fan means is operating and a valve member of the control device is in an open condition thereof, said method comprising the step of forming said control device to have a housing means provided with a movable valve member for controlling the amount of opening of said air circulating means between said compartments and a temperature sensing means having movable means operatively interconnected to said valve member to control the position of said valve member in relation to the temperature sensed by said temperature sensing means, the improvement comprising the step of forming said movable means of said temperature sensing means to be adapted to be operatively interconnected to said fan means for causing said fan means to be operating only when said valve member is in a certain open condition thereof.

14. In a method of making a control device for a refrigerator system having a frozen food compartment and a non-frozen food compartment interconnected together by an air circulating means that has a fan means therein for forcing an air flow through said air circulating means from said frozen food compartment to said non-frozen food compartment when said fan means is operating and a valve member of the control device is in an open condition thereof, said method comprising the step of forming said control device to have a housing means provided with a movable valve member for controlling the amount of opening of said air circulating means between said compartments and a temperature sensing means operatively interconnected to said valve member to control the position of said valve member in relation to the temperature sensed by said temperature sensing means, the improvement comprising the steps of forming said control device to have means for causing said fan means to be operating only when said valve member is in a certain open conditions thereof, forming said means of said control device for causing said fan means to be operating only when said valve member is in a certain open condition thereof to comprise an electrical switch means carried by said housing means, forming said switch means to be adapted to cause said fan means to be operating only when said switch means is actuated to a certain condition thereof, and forming said temperature sensing means to have means operatively interconnected with said switch means to actuate said switch means to said certain condition thereof only when said temperature sensing means is causing said valve member to be in said certain open condition thereof.

15. A method of making a control device as set forth in claim 14 and including the step of forming said means of said temperature sensing means that is operatively interconnected to said switch means to comprise a lever that is pivotally mounted to said housing means.

16. A method of making a control device as set forth in claim 15 and including the steps of forming said switch means to have an axially movable plunger means which when moved a certain amount actuates said switch means, and forming said lever to have an abutment means that is adapted to be in engagement with said plunger means whereby said plunger means is adapted to move in unison with said lever.

17. A method of making a control device as set forth in claim 16 and including the step of forming said switch mean to be adjustably mounted to said housing means.

18. A method of making a control device as set forth in claim 17 and including the steps of forming said housing means to have an exterior surface means, and forming said switch means to be slideably mounted on said exterior surface means of said housing means.

19. In a method of making a refrigerator system having a frozen food compartment and a non-frozen food compartment interconnected together by an air circulating means that has a control valve means therein for controlling the amount of opening of said air circulating means between said compartments, said method comprising the steps of forming said control valve means to have a housing means provided with a movable valve member and a temperature sensing means having movable means operatively interconnected to said valve member to control the position of said valve member in relation to the temperature sensed by said temperature sensing means, and forming said system to have a fan means for forcing an air flow through said air circulating means from said frozen food compartment to said non-frozen food compartment when said fan means is operating and said valve member is in an open condition thereof, the improvement comprising the step of operatively interconnecting said movable means of said temperature sensing mean to said fan means for causing said fan means to be operating only when said valve member is in a certain open condition thereof.

20. In a method of making a refrigerator system having a frozen food compartment and a non-frozen food compartment interconnected together by an air circulating means that has a control valve means therein for controlling the amount of opening of said air circulating means between said compartments, said method comprising the steps of forming said control valve means to have a housing means provided with a movable valve member and a temperature sensing means operatively interconnected to said valve member to control the position of said valve member in relation to the temperature sensed by said temperature sensing means, and forming said system to have a fan means for forcing an air flow through said air circulating means from said frozen food compartment to said non-frozen food compartment when said fan means is operating and said valve member is in an open condition thereof, the improvement comprising the steps of forming said system to have means for causing said fan means to be operating only when said valve member is in a certain open condition thereof, forming said means of said control device for causing said fan means to be operating only when said valve member is in a certain open condition thereof to comprise an electrical switch means carried by said housing means, forming said switch means to be adapted to cause said fan means to be operating only when said switch means is actuated to a certain condition thereof, and forming said temperature sensing means to have means operatively interconnected with said switch means to actuate said switch means to said certain condition thereof only when said temperature sensing means is causing said valve member to be in said certain open condition thereof.

21. A method of making a system as set forth in claim 20 and including the step of forming said means of said temperature sensing means that is operatively interconnected to said switch means to comprise a lever that is pivotally mounted to said housing means.

22. A method of making a system as set forth in claim 21 and including the steps of forming said switch means to have an axially movable plunger means which when moved a certain amount actuates said switch means, and forming said lever to have an abutment means that is adapted to be in engagement with said plunger means whereby said plunger means is adapted to move in unison with said lever.

23. A method of making a system as set forth in claim 22 and including a the step of forming said switch means to be adjustably mounted to said housing means.

24. A method of making a system as set forth in claim 23 and including the steps of forming said housing means to have an exterior surface means, and forming said switch means to be slideably mounted on said exterior surface means of said housing means.

* * * * *